US010600535B2

(12) United States Patent
Comoret et al.

(10) Patent No.: US 10,600,535 B2
(45) Date of Patent: Mar. 24, 2020

(54) ELECTRICAL TRANSPORT WIRE MADE OF AN ALUMINUM ALLOY, HAVING HIGH ELECTRICAL CONDUCTIVITY

(71) Applicant: NEXANS, Paris (FR)

(72) Inventors: Emilien Comoret, Rouvray (FR); Rodrigue Sumera, Epinoy (FR); Nicolas Masquelier, Phalempin (FR)

(73) Assignee: NEXANS, Courbevoie (FR)

( * ) Notice: Subject to any disclaimer, the term of this patent is extended or adjusted under 35 U.S.C. 154(b) by 174 days.

(21) Appl. No.: 14/434,568

(22) PCT Filed: Oct. 16, 2013

(86) PCT No.: PCT/FR2013/052475
§ 371 (c)(1),
(2) Date: Apr. 9, 2015

(87) PCT Pub. No.: WO2014/064370
PCT Pub. Date: May 1, 2014

(65) Prior Publication Data

US 2015/0279518 A1 Oct. 1, 2015

(30) Foreign Application Priority Data

Oct. 17, 2012 (FR) ..... 12 59882

(51) Int. Cl.
*H01B 9/00* (2006.01)
*C22C 21/00* (2006.01)
(Continued)

(52) U.S. Cl.
CPC ..... *H01B 9/008* (2013.01); *B21C 9/00* (2013.01); *B21C 37/045* (2013.01); *C21D 9/525* (2013.01);
(Continued)

(58) Field of Classification Search
CPC ..... B21C 37/045; B21C 9/00; C21D 9/525; C22C 1/026; C22C 21/00; C22F 1/04;
(Continued)

(56) References Cited

U.S. PATENT DOCUMENTS 3,961,111 A 6/1976 Smith
4,402,763 A 9/1983 Sato et al.
(Continued)

FOREIGN PATENT DOCUMENTS

EP 0787811 8/1997
EP 2693447 2/2014
(Continued)

OTHER PUBLICATIONS

Field ion microscopy and 3-D atom probe analysis of Al3Zr particles in 7050 Al alloy G. Sha, A. Cerezc Ultramicroscopy vol. 102, Issue 2, Jan. 2005, pp. 151-159.*
(Continued)

*Primary Examiner* — Jenny R Wu
(74) *Attorney, Agent, or Firm* — Sofer & Haroun, LLP

(57) ABSTRACT

The invention relates to an electrical transportation wire made of aluminum alloy comprising aluminum, zirconium and unavoidable impurities, characterized in that said alloy comprises at least 80 parts by weight of zirconium in the form of precipitates ($Al_3Zr$) per 100 parts by weight of zirconium in said aluminum alloy.

25 Claims, 3 Drawing Sheets

(51) Int. Cl.

| | |
|---|---|
| ***H01B 1/02*** | (2006.01) |
| ***C22F 1/04*** | (2006.01) |
| ***B21C 9/00*** | (2006.01) |
| ***C22C 1/02*** | (2006.01) |
| ***B21C 37/04*** | (2006.01) |
| ***C21D 9/52*** | (2006.01) |
| ***C25D 7/06*** | (2006.01) |
| ***C25D 11/04*** | (2006.01) |
| ***H01B 13/00*** | (2006.01) |
| ***H01B 13/32*** | (2006.01) |

(52) U.S. Cl.
CPC ..... *C22C 1/026* (2013.01); *C22C 21/00* (2013.01); *C22F 1/04* (2013.01); *C25D 7/0607* (2013.01); *C25D 11/04* (2013.01); *H01B 1/023* (2013.01); *H01B 13/0016* (2013.01); *H01B 13/0036* (2013.01); *H01B 13/32* (2013.01); *Y10T 29/49991* (2015.01)

(58) Field of Classification Search
CPC .. C25D 11/04; C25D 7/0607; H01B 13/0016; H01B 13/0036; H01B 13/32; H01B 1/023; H01B 9/008; Y10T 29/49991; H01L 313/0016; H01L 313/0036; H01L 313/32; H01L 31/023; H01L 39/008
USPC ..... 174/70 A; 205/112, 50; 29/527.7; 420/538; 432/18
See application file for complete search history.

(56) References Cited

U.S. PATENT DOCUMENTS

| | | | | |
|---|---|---|---|---|
| 5,067,994 | A | 11/1991 | Brubak et al. | |
| 2003/0059336 | A1* | 3/2003 | Aida | B21C 23/005 420/535 |
| 2012/0217060 | A1* | 8/2012 | Kusakari | C22C 21/02 174/72 A |
| 2013/0264115 | A1* | 10/2013 | Kobayashi | H01B 1/023 174/72 A |
| 2014/0099231 | A1* | 4/2014 | Ishibashi | C22C 21/00 420/534 |

FOREIGN PATENT DOCUMENTS

| | | | |
|---|---|---|---|
| JP | 2006079885 | A * | 3/2006 |
| JP | 2009099450 | | 5/2009 |

OTHER PUBLICATIONS

Search Report dated 2014.
International Search Report dated Jul. 15, 2019.

* cited by examiner

ELECTRICAL TRANSPORT WIRE MADE OF AN ALUMINUM ALLOY, HAVING HIGH ELECTRICAL CONDUCTIVITY

RELATED APPLICATIONS

This application is a National Phase Application of PCT/FR2013/052475, filed on Oct. 16, 2013, which in turn claims the benefit of priority from French Patent Application No. 12 59882 filed on Oct. 17, 2012, the entirety of which are incorporated herein by reference.

BACKGROUND

Field of the Invention

The invention relates to an electric cable comprising at least one electrical transportation wire made of aluminum alloy, to a process for the manufacture of said electrical transportation wire and to a process for the manufacture of said electric cable.

It applies typically but not exclusively to high voltage electrical transmission cables or aerial cables for the transportation of energy, well known as overhead line (OHL) cables.

Description of Related Art

These cables are conventionally composed of a central reinforcing component, surrounded by at least one electrically conducting layer.

The central reinforcing component can be a composite or metal component. Mention may be made, by way of example, of steel strands or composite aluminum strands in an organic matrix.

For its part, the electrically conducting layer can typically comprise an assembly of metal strands, preferably twisted around the central component. The metal strands can be strands made of aluminum, copper, aluminum alloy or copper alloy. This being the case, the electrically conducting layer is generally manufactured based on aluminum or an aluminum alloy since this material exhibits a fairly low weight in comparison with other electrically conducting materials.

The document EP 0 787 811 teaches an electrical transportation wire made of aluminum alloy which provides good tensile strength and good temperature stability. This alloy comprises from 0.28 to 0.80 percent by weight of zirconium, from 0.10 to 0.80 percent by weight of manganese and from 0.10 to 0.40 percent by weight of copper. This alloy is obtained by a process comprising a stage of casting the molten aluminum alloy, then an extrusion or rolling stage, then a heating stage and finally a cold working stage, in order to obtain alloy wires with a diameter of 4 mm. The heating stage can be carried out after the cold working stage.

However, this alloy exhibits the disadvantage of having an electrical conductivity of less than 56.5% IACS (International Annealed Copper Standard), indeed even of less than 51% IACS, depending on the operating conditions used. Furthermore, the process for the manufacture of said alloy does not make it possible, on the one hand, to control the microstructure of the zirconium precipitates ($Al_3Zr$) and, on the other hand, to produce sufficient zirconium precipitates in said alloy. For this reason, this process brings about a tensile strength and an electrical conductivity of said alloy which are not optimized.

OBJECTS AND SUMMARY

The aim of the present invention is to overcome the disadvantages of the techniques of the prior art by providing an aluminum alloy, in particular used as electrical transportation wire in an electric cable, which comprises aluminum and zirconium, which is easy to manufacture and which exhibits improved electrical properties (in terms of electrical capacitance and of electrical conductivity), or guaranteeing good mechanical properties, in particular in terms of tensile strength and hot creep resistance, and good temperature stability.

In order to do this, a first subject matter of the present invention is an electrical transportation wire made of aluminum alloy comprising aluminum, zirconium and unavoidable impurities, characterized in that said alloy comprises at least 80 parts by weight of zirconium in the form of precipitates ($Al_3Zr$) per 100 parts by weight of zirconium in said aluminum alloy.

By virtue of the presence of at least 80 parts by weight of zirconium in the form of precipitates ($Al_3Zr$) per 100 parts by weight of zirconium in said aluminum alloy, the aluminum alloy of the electrical transportation wire of the invention exhibits a greater electrical conductivity than that of the aluminum alloys of the prior art, while guaranteeing good electrical properties.

In a specific embodiment, said electrical transportation wire comprises, at the surface, a porous layer of alumina hydroxide.

In the invention, the layer of alumina hydroxide is a layer of aluminum hydroxide oxide or, in other words, a layer of alumina hydrate.

By virtue of the porous layer of alumina hydroxide, the thermal emissivity is optimized and thermal absorption is minimized, which is favorable to a significant decrease in the heating of the electrical transportation wire, which might become weakened at high temperatures.

A second subject matter of the present invention is an electrical transportation wire made of aluminum alloy comprising aluminum, zirconium precipitates and unavoidable impurities, characterized in that said electrical transportation wire comprises, at the surface, a porous layer of alumina hydroxide.

By virtue of the porous layer of alumina hydroxide, the thermal emissivity is optimized and the thermal absorption is minimized, which is favorable to a significant decrease in the heating of the electrical transportation wire, which might become weakened at high temperatures, and thus to the improvement in the electrical properties, while guaranteeing good mechanical properties.

In a specific embodiment, said alloy comprises at least 80 parts by weight of zirconium in the form of precipitates ($Al_3Zr$) per 100 parts by weight of zirconium in said aluminum alloy.

By virtue of the presence of at least 80 parts by weight of zirconium in the form of precipitates ($Al_3Zr$) per 100 parts by weight of zirconium in said aluminum alloy, the aluminum alloy of the electrical transportation wire in accordance with the second subject matter of the invention exhibits a greater electrical conductivity than that of the aluminum alloys of the prior art.

In a specific embodiment, the electrical transportation wire made of aluminum alloy in accordance with the first subject matter or with the second subject matter of the invention is an electrical transportation wire composed of said aluminum alloy.

According to a first alternative form of the first subject matter or of the second subject matter of the invention, the layer of alumina hydrate is a monohydrate layer.

Mention may be made, by way of example, as alumina monohydrate, of boehmite, which is the gamma polymorph of AlO(OH) or $Al_2O_3.H_2O$, or diaspore, which is the alpha polymorph of AlO(OH) or $Al_2O_3.H_2O$.

According to a second alternative form of the first subject matter or of the second subject matter of the invention, the layer of alumina hydrate is a polyhydrate layer and preferably a trihydrate layer.

Mention may be made, by way of example, as alumina trihydrate, of gibbsite or hydrargillite, which is the gamma polymorph of $Al(OH)_3$, bayerite, which is the alpha polymorph of $Al(OH)_3$, or nordstrandite, which is the beta polymorph of $Al(OH)_3$.

In a specific embodiment of the first subject matter or of the second subject matter of the invention, the electrical transportation wire comprises a dispersion of controlled microstructure of zirconium precipitates ($Al_3Zr$).

By virtue of the dispersion of controlled microstructure of zirconium precipitates ($Al_3Zr$), the mechanical and thermal properties of the aluminum alloy and thus of the electrical transportation wire are improved.

In the electrical transportation wire in accordance with the first subject matter or with the second subject matter of the invention, the aluminum alloy can comprise from 0.05% to 0.6% by weight of zirconium, preferably from 0.05% to 0.5% by weight of zirconium and more preferably from 0.2% to 0.5% by weight of zirconium.

When the amount of zirconium in said aluminum alloy is less than 0.05% by weight, the aluminum alloy may not comprise sufficient zirconium precipitates, resulting in a random distribution of said precipitates in the alloy and thus in a decrease in its electrical conductivity. When the amount of zirconium in said aluminum alloy is greater than 0.5% by weight, large zirconium precipitates ($Al_3Zr$) may be formed, resulting in a deterioration in the mechanical properties of the alloy, in particular in terms of tensile strength.

In a specific embodiment, the diameter of the zirconium precipitates ($Al_3Zr$) in said alloy of the electrical transportation wire in accordance with the first subject matter or with the second subject matter of the invention ranges from 1 to 100 nm, preferably from 1 to 20 nm and more preferably from 1 to 5 nm. When the diameter of the precipitates decreases, the temperature stability of the alloy of the electrical transportation wire of the invention is improved. Thus, the alloy of the electrical transportation wire in accordance with the first subject matter or with the second subject matter of the invention can withstand a temperature of 150° C. and preferably a temperature of 210° C.

In a specific embodiment, said zirconium precipitates ($Al_3Zr$) are spherical.

In a preferred embodiment, the aluminum alloy of the electrical transportation wire in accordance with the first subject matter or with the second subject matter of the invention additionally comprises an element chosen from copper, iron and their mixture.

The presence of iron in said aluminum alloy makes it possible to improve the mechanical properties with respect to the tensile strength, while maintaining a good electrical conductivity.

The aluminum alloy of the electrical transportation wire in accordance with the first subject matter or with the second subject matter of the invention can comprise from 0.15% to 0.4% by weight of iron and preferably from 0.25% to 0.35% by weight of iron.

The presence of the copper in the aluminum alloy of the electrical transportation wire in accordance with the first subject matter or with the second subject matter of the invention makes it possible to improve the mechanical properties with respect to the hot creep resistance, while maintaining a good electrical conductivity. An alloy having a good hot creep resistance withstands deformation under long-term mechanical stresses at high temperatures.

The aluminum alloy of the electrical transportation wire in accordance with the first subject matter or with the second subject matter of the invention can comprise from 0.05% to 0.35% by weight of copper and preferably from 0.12% to 0.22% by weight of copper.

The electrical conductivity of the aluminum alloy of the electrical transportation wire in accordance with the first subject matter or with the second subject matter of the invention can be at least 57% IACS (International Annealed Copper Standard), preferably at least 58% IACS and preferably at least 59% IACS.

It is preferable for the aluminum alloy of the electrical transportation wire in accordance with the first subject matter or with the second subject matter of the invention to comprise solely aluminum, zirconium, unavoidable impurities and optionally an element chosen from iron, copper and their mixture. This is because, if other elements are also added to the alloy, the electrical conductivity can fall significantly. For electrical applications, it is important to keep the aluminum alloy as pure as possible.

The aluminum content of the aluminum alloy of the electrical transportation wire in accordance with the first subject matter or with the second subject matter of the invention can be at least 95.00% by weight, preferably at least 98.00% by weight, preferably at least 99.00% by weight and preferably at least 99.40% by weight.

The content of unavoidable impurities in the aluminum alloy of the electrical transportation wire in accordance with the first subject matter or with the second subject matter of the invention can be at most 1.50% by weight, preferably at most 1.10% by weight, preferably at most 0.60% by weight, preferably at most 0.30% by weight and preferably at most 0.10% by weight.

In the present invention, "unavoidable impurities" is understood to mean the sum of the metal or nonmetal elements included in the alloy, apart from aluminum, zirconium, iron, copper and optionally oxygen, during the manufacture of said alloy.

These unavoidable impurities can, for example, be one or more of the following elements: Ag, Cd, Cr, Mg, Mn, Pb, Si, Ti, V, Ni, S and/or Zn.

These unavoidable impurities are generally impurities intrinsic to the aluminum.

In a specific embodiment, the aluminum alloy comprises at most 0.08% by weight and preferably at most 0.05% by weight of Mn and/or Si. This is because these unavoidable impurities can reduce the electrical conductivity of said alloy.

A third subject matter of the present invention is an electric cable comprising at least one electrical transportation wire in accordance with the first subject matter or with the second subject matter of the invention, characterized in that said electric cable additionally comprises an elongated reinforcing component.

In the present invention, the presence of an elongated reinforcing component makes it possible in particular to form an aerial cable for the transportation of energy (i.e. OHL cable).

Preferably, the elongated reinforcing component is surrounded by said electrical transportation wire made of aluminum alloy.

In a specific embodiment, the elongated reinforcing component is a central component.

The elongated reinforcing component is preferably a central mechanical support rod.

In the context of the invention, "electrical transportation wire made of aluminum alloy in accordance with the first subject matter or with the second subject matter of the invention" is understood to mean a "metal strand" or an "elongated electrically conducting component".

Particularly preferably, the electric cable in accordance with the third subject matter of the invention comprises an assembly (i.e. a plurality) of electrical transportation wires made of aluminum alloy in accordance with the first subject matter or with the second subject matter of the invention, these wires being in particular wound around the elongated reinforcing component. This assembly can in particular form at least one layer of the continuous casing type, for example with a circular or oval or also square cross section.

When the electric cable of the invention comprises an elongated reinforcing component, said assembly can be positioned around the elongated reinforcing component.

The metal strands can be round, trapezoidal or Z-shaped in cross section.

When the strands are round in cross section, they can have a diameter which can range from 2.25 mm to 4.75 mm. When the strands are not round in cross section, their round-section equivalent diameter can also range from 2.25 mm to 4.75 mm.

Of course, it is preferable for all the constituent strands of an assembly to have the same shape and the same dimensions.

In a preferred embodiment of the invention, the elongated reinforcing component is surrounded by at least one layer of an assembly of metal strands made of aluminum alloy in accordance with the first subject matter or with the second subject matter of the invention.

Preferably, the constituent metal strands of at least one layer of an assembly of metal strands made of aluminum alloy of the invention are capable of conferring, on said layer, a substantially uniform surface, it being possible for each constituent strand of the layer in particular to exhibit a cross section complementary in shape to the strand(s) which is/are adjacent to it.

According to the invention, "metal strands capable of conferring, on said layer, a substantially uniform surface, it being possible for each constituent strand of the layer in particular to exhibit a cross section complementary in shape to the strand(s) which is/are adjacent to it" is understood to mean that: the juxtaposition or the interlocking of the assembly of constituent strands of the layer forms a continuous casing (devoid of irregularities), for example with a circular or oval or also square section.

Thus, the strands with a Z-shaped or trapezoid-shaped cross section make it possible to obtain a uniform casing, in contrast to the strands with a round cross section. In particular, strands with a Z-shaped cross section are preferred.

More preferably still, said layer formed by the assembly of the metal strands exhibits a ring-shaped cross section.

The elongated reinforcing component can typically be a composite or metal component. Mention may be made, by way of example, of steel strands or composite strands of aluminum in an organic matrix.

The electrical transportation wire of the invention can be twisted around the elongated reinforcing component, in particular when the electric cable of the invention comprises an assembly of electrical transportation wires made of aluminum alloy in accordance with the first or with the second subject matter of the invention (i.e. metal strands).

A fourth subject matter of the present invention is a process for the manufacture of an electrical transportation wire in accordance with the first subject matter of the invention, said process being characterized in that it comprises the following stages:

i) forming a molten aluminum alloy comprising aluminum, zirconium, unavoidable impurities and optionally an element chosen from copper, iron and their mixture;

ii) casting the molten alloy of stage i), in order to obtain an as-cast alloy;

iii) rolling the as-cast alloy of stage ii), in order to obtain a rolled alloy;

iv) heating the rolled alloy of stage iii), in order to obtain said electrical transportation wire made of aluminum alloy, said alloy comprising at least 80 parts by weight of zirconium in the form of precipitates ($Al_3Zr$) per 100 parts by weight of zirconium in said aluminum alloy.

The inventors of the present patent application have discovered, surprisingly, that the electrical conductivity of the alloy obtained on conclusion of the heating stage iv) is increased. Thus, by virtue of the process of the invention and in particular by virtue of the heating stage iv), sufficient zirconium precipitates are formed to make possible the increase in the electrical conductivity with respect to a zirconium-comprising alloy of the prior art. In addition, the addition of iron and/or copper to the alloy, combined with the heating stage iv) of the process of the invention, results in an alloy simultaneously exhibiting improved mechanical properties, in particular in terms of hot creep resistance and tensile strength, and a better electrical conductivity.

Stage i) can conventionally be carried out by incorporating a master alloy, comprising aluminum, zirconium and optionally iron and/or copper, in a bath of molten aluminum which is substantially pure. Stage i) can also be carried out by addition to molten aluminum of the zirconium and optionally of an element chosen from copper, iron and their mixture, followed by mixing.

Stage ii) makes it possible in particular, by cooling the as-cast product (i.e. solidification), to form an as-cast aluminum alloy, in particular in the rod or bar form, which form is preferably cylindrical. The cross section of the bar can range, for example, from 500 $mm^2$ to 2500 $mm^2$, and even more.

In a specific embodiment, the casting temperature during stage ii) ranges from 680° C. to 850° C. approximately and preferably from 710° C. to 770° C. approximately.

In a specific embodiment, the cooling during the casting stage ii) is carried out at a rate of at least 50° C./min, from the casting temperature down to approximately 500° C.

By way of example, the casting stage can be carried out continuously, in particular using a rotating "casting" wheel.

Stage iii) makes it possible to roll said as-cast aluminum alloy, in order to obtain a rolled alloy.

The casting stage ii) and the rolling stage iii) make it possible to control the microstructure of the zirconium precipitates in said alloy by preventing the formation of large zirconium precipitates and thus guarantee that an aluminum alloy is obtained which exhibits good mechanical properties, in particular in terms of tensile strength.

Said rolled alloy has a preferably round cross section. The diameter of the cross section can range, for example, from 7 mm to 26 mm approximately.

In a specific embodiment, the rolling stage iii) can be carried out under hot conditions, in particular at a temperature ranging from 400 to 550° C. approximately.

Stage iv) of heating the rolled alloy makes it possible, for its part, to control the microstructure of the zirconium precipitates in said alloy and also to form sufficient zirconium precipitates. Thus, on conclusion of stage iv), said aluminum alloy manufactured according to the process of the invention comprises at least 80 parts by weight of zirconium in the form of precipitates per 100 parts by weight of zirconium in said aluminum alloy.

In a specific embodiment, this stage iv) makes it possible to obtain at least 90 parts by weight of zirconium in the form of precipitates per 100 parts by weight of zirconium in the aluminum alloy manufactured according to the process of the invention.

This stage iv) can preferably be a "tempering" stage well known to a person skilled in the art, said tempering stage being in particular different from an "annealing" stage. The annealing stage makes it possible to increase the mechanical lengthening of an alloy by heating it and thus to be able to deform it easily once annealed, whereas the tempering stage for its part makes it possible to increase the mechanical strength of the alloy.

In a specific embodiment, stage iv) is carried out at a temperature ranging from 300 to 500° C. approximately, preferably from 350 to 450° C. and more preferably still from 400 to 450° C.

In a preferred embodiment, the duration of the heating stage iv) ranges from 100 to 500 hours, preferably from 100 to 350 hours and more preferably still from 100 to 300 hours.

It is important to note that the temperature and time parameters used during said stage iv) are interdependent. Mention may in particular be made, as examples of time/temperature pairs used during stage iv), of the following time/temperature pairs: 100 hours/450° C., 200 hours/400° C. and 340 hours/350° C.

The control of the heating time during stage iv) by a given temperature can be carried out by transmission electron microscopy.

The heating according to stage iv) can be carried out using an electric furnace (i.e. resistance furnace) and/or an induction furnace and/or a gas furnace.

In order to improve the formation of the zirconium precipitates ($Al_3Zr$), the heating of stage iv) can be carried out by performing a slow rise in temperature, in particular of 5° C. per minute approximately.

According to a specific embodiment, the process for the manufacture of the electrical transportation wire in accordance with the first subject matter of the invention additionally comprises the following stage:

v) cold working said electrical transportation wire of stage iv), in order to obtain an electrical transportation wire with the desired dimensions.

The cold working stage v) can be a wire drawing stage, in order to obtain said electrical transportation wire with the desired dimensions (e.g., final diameter). It can be carried out at a temperature of at most 80° C. approximately.

According to a preferred embodiment, stage v) makes it possible to obtain metal strands (or electrical transportation wires) of aluminum alloy, in particular with a round or trapezoidal or Z-shaped cross section. The diameter of the cross section can range from 0.2 mm to 5.0 mm.

According to a preferred embodiment, the process in accordance with the fourth subject matter of the invention additionally comprises the following stage:

vi) forming, by chemical conversion, a porous layer of alumina hydroxide at the surface of said electrical transportation wire.

Stage vi) can be carried out with the electrical transportation wire resulting from stage iv) or resulting from stage v), if it exists.

In a preferred embodiment, the porous layer of alumina hydroxide surrounding said electrical transportation wire and formed during stage vi) is preferably a layer which is directly in physical contact with said electrical transportation wire made of aluminum alloy. In other words, the electrical cable thus formed preferably does not comprise a layer interposed between the porous layer of alumina hydroxide and said electrical transportation wire made of aluminum alloy.

The pores of said porous layer of alumina hydroxide are optionally arranged substantially uniformly (or homogeneously) all along the external surface of the porous layer of alumina hydroxide and they optionally have very substantially the same dimensions.

A fifth subject matter of the present invention is a process for the manufacture of an electrical transportation wire in accordance with the second subject matter of the invention, said process being characterized in that it comprises the following stages:

A) forming a molten aluminum alloy comprising aluminum, zirconium, unavoidable impurities and optionally an element chosen from copper, iron and their mixture, B) casting the molten alloy obtained in stage A), in order to obtain an as-cast alloy, in particular in the form of a rod, C) rolling the as-cast alloy of stage B), in order to obtain a rolled alloy, D) heating the rolled alloy of stage C), E) optionally wire drawing the alloy obtained in stage D), in order to obtain said electrical transportation wire with the final diameter desired, and F) forming said porous layer of alumina hydroxide by chemical conversion.

Stage A) can conventionally be carried out by incorporating a master alloy, comprising aluminum, zirconium and optionally iron and/or copper, in a bath of molten aluminum which is substantially pure. Stage A) can also be carried out by addition to molten aluminum of the zirconium and optionally of an element chosen from copper, iron and their mixture, followed by mixing.

Stage B) makes it possible in particular, by cooling the as-cast product (i.e. solidification), to form an as-cast aluminum alloy, in particular in the rod or bar form, which form is preferably cylindrical. The cross section of the bar can range, for example, from 500 $mm^2$ to 2500 $mm^2$, and even more.

In a specific embodiment, the casting temperature during stage B) ranges from 680° C. to 850° C. approximately and preferably from 710° C. to 770° C. approximately.

In a specific embodiment, the cooling during the casting stage B) is carried out at a rate of at least 50° C./min, from the casting temperature down to approximately 500° C.

By way of example, the casting stage can be carried out continuously, in particular using a rotating "casting" wheel.

Stage C) makes it possible to roll said as-cast aluminum alloy, in order to obtain a rolled alloy.

The casting stage B) and the rolling stage C) make it possible to control the microstructure of the zirconium precipitates in said alloy by preventing the formation of large zirconium precipitates and thus guarantee that an aluminum alloy is obtained which exhibits good mechanical properties, in particular in terms of tensile strength.

Said rolled alloy has a preferably round cross section. The diameter of the cross section can range, for example, from 7 mm to 26 mm approximately.

In a specific embodiment, the rolling stage C) can be carried out under hot conditions, in particular at a temperature ranging from 400 to 550° C. approximately.

In a specific embodiment, stage D) is carried out at a temperature ranging from 300 to 500° C. approximately, preferably from 350 to 450° C. and more preferably still from 400 to 450° C.

In a preferred embodiment, the duration of the heating stage D) ranges from 100 to 500 hours, preferably from 100 to 350 hours and more preferably still from 100 to 300 hours.

In an even more preferred embodiment, stage D) is carried out at a temperature between 400 and 450° C. for 100 to 500 hours.

It is important to note that the temperature and time parameters used during said stage D) are interdependent. Mention may in particular be made, as examples of time/temperature pairs used during stage D), of the following time/temperature pairs: 100 hours/450° C. and 200 hours/400° C.

The control of the heating time during stage D) by a given temperature can be carried out by transmission electron microscopy.

Stage D) of heating of the rolled alloy (i.e. heat treatment stage) makes it possible to control the microstructure of the zirconium precipitates in said alloy and also to form sufficient zirconium precipitates. Thus, on conclusion of stage D), said aluminum alloy manufactured according to the process in accordance with the fifth subject matter of the invention can comprise at least 80 parts by weight of zirconium in the form of precipitates per 100 parts by weight of zirconium in said aluminum alloy.

In order to improve the formation of the zirconium precipitates ($Al_3Zr$), the heating of stage D) can be carried out by performing a slow rise in temperature, in particular of 5° C. per minute approximately.

Advantageously, this stage D) makes it possible to obtain at least 90 parts by weight of zirconium in the form of precipitates per 100 parts by weight of zirconium in the aluminum alloy manufactured according to the process in accordance with the fifth subject matter of the invention.

This stage D) can preferably be a "tempering" stage well known to a person skilled in the art, said tempering stage being in particular different from an "annealing" stage. The annealing stage makes it possible to increase the mechanical lengthening of an alloy by heating it and thus to be able to easily deform it once annealed, whereas the tempering stage for its part makes it possible to increase the mechanical strength of the alloy.

The heating according to stage D) can be carried out using an electrical furnace (i.e. resistance furnace) and/or an induction furnace and/or a gas furnace.

Stage E) of wire drawing makes it possible to obtain said electrical transportation wire with the desired dimensions (e.g., final diameter). It can be carried out at a temperature of at most 80° C. approximately.

According to a preferred embodiment, stage E) makes it possible to obtain metal strands (or electrical transportation wires) of aluminum alloy, in particular with a round or trapezoidal or Z-shaped cross section. The diameter of the cross section can range from 0.2 mm to 5.0 mm.

In a preferred embodiment, the porous layer of alumina hydroxide surrounding said electrical transportation wire and formed during stage F) is preferably a layer which is directly in physical contact with said electrical transportation wire made of aluminum alloy. In other words, the electric cable thus formed preferably does not comprise a layer interposed between the porous layer of alumina hydroxide and the electrical transportation wire made of aluminum alloy.

The pores of said porous layer of alumina hydroxide are optionally arranged substantially uniformly (or homogeneously) all along the external surface of the porous layer of alumina hydroxide and they optionally have very substantially the same dimensions.

In a particularly advantageous embodiment, stage vi) of the process in accordance with the fourth subject matter of the invention or stage F) of the process in accordance with the fifth subject matter of the invention is carried out by anodizing.

Anodizing is a surface treatment which makes it possible to form the porous layer of alumina hydroxide by anodic oxidation starting from the electrical transportation wire resulting from stage iv) (or from stage D)) or from stage v) (or from stage E)), if it exists. Thus, the anodizing will consume a portion of the electrical transportation wire in order to form said porous layer of alumina hydroxide.

During the anodizing, the porous layer of alumina hydroxide is formed starting from the surface of said electrical transportation wire toward the core of said electrical transportation wire, contrary to an electrolytic deposition.

The anodizing is conventionally based on the principle of the electrolysis of water. It consists in immersing the electrical transportation wire in an anodizing bath, said electrical transportation wire being placed at the positive pole of a direct current generator.

The anodizing bath is more particularly an acid bath, preferably a phosphoric acid bath or a sulfuric acid bath. The term "phosphoric acid anodizing" or "sulfuric acid anodizing" is then used respectively.

When the porous layer of alumina hydroxide is advantageously formed by anodizing, the electrolytic parameters are imposed by a current density and a conductivity of the bath. For a desired thickness on a prototypical electrical transportation wire of 8 to 10 μm, the current density is preferably set at from 55 to 65 $A/dm^2$, the voltage is set at from 20 to 21 V and the intensity is set at from 280 to 350 A.

This current density makes it possible to guarantee that a sufficient amount of pores has been formed.

The process in accordance with the fourth subject matter or with the fifth subject matter of the invention can additionally comprise at least one of the following stages, prior to the chemical conversion stage vi) or F):

a) degreasing said electrical transportation wire, and/or b) stripping said electrical transportation wire.

Preferably, stage a) and stage b) can be carried out simultaneously.

Furthermore, the process in accordance with the fourth subject matter or with the fifth subject matter of the invention can additionally comprise the following stage, prior to the chemical conversion stage vi) or F):

c) neutralizing said electrical transportation wire.

In a particularly preferred embodiment, the process in accordance with the fourth subject matter or with the fifth subject matter of the invention can comprise said three stages a), b) and c), stage c) being carried out after stages a) and b).

The object of the degreasing stage a) is to remove the various bodies and particles present in the greases liable to be present on the surface of the electrical transportation wire.

It can be carried out by the chemical route or helped by the electrolytic route.

By way of example, the degreasing stage a) can be carried out by at least partially immersing the electrical transportation wire in a solution comprising at least one surfactant as degreasing agent.

The stripping stage b) is used to remove the oxides liable to be present on the surface of the electrical transportation wire. Several stripping methods exist: chemical, electrolytic or mechanical.

Preferably, it will be possible to use a chemical stripping which consists in removing the oxides by dissolution, indeed even by fragmentation, of the oxide layer, without attacking the material of the underlying electrical transportation wire.

By way of example, the stripping stage b) can be carried out by at least partially immersing the electrical transportation wire in a solution comprising a base as stripping agent.

When stage a) and stage b) are carried out simultaneously, a single solution comprising a degreasing agent and a stripping agent can be used in order to simultaneously strip and degrease the electrical transportation wire.

The neutralizing stage c) makes it possible to condition the electrical transportation wire, before the chemical conversion stage vi) or F).

More particularly, when the chemical conversion stage vi) or F) is an anodizing stage, the neutralizing stage c) consists in conditioning the electrical transportation wire by at least partially immersing it in a solution identical to the anodizing bath planned for the chemical conversion stage vi) or F), in order to put the surface of the electrical transportation wire at the same pH as the anodizing bath of the anodizing stage vi) or F).

In addition, this solution makes it possible on the one hand, to remove some traces of oxide which may be harmful to the anodizing and, on the other hand, to remove possible residues of the stripping agent. The neutralizing makes it possible to put the surface of the aluminum at the same pH as the anodic bath.

By way of example, the neutralizing stage c) can be carried out by at least partially immersing the electrical transportation wire in a solution comprising an acid as neutralizing agent.

By way of example, it is preferable first of all to strip and to degrease said electrical transportation wire made of aluminum by immersing it in a solution of sodium hydroxide and of surfactants, such as, for example, the solution referenced Gardoclean sold by Chemetall (30-50 g/l of sodium hydroxide), in particular at a temperature ranging from 40 to 60° C. approximately, for a period of time of 30 seconds approximately. Said electrical transportation wire can then be immersed in a sulfuric acid solution (20% by weight of sulfuric acid in distilled water) in order to carry out the neutralizing stage c), preferably at ambient temperature (i.e. 25° C.), for 10 seconds.

Prior to the anodizing stage vi) or F), said electrical transportation wire can subsequently be smoothed, in order to exhibit a bright appearance, and then rinsed. The brightening makes it possible to remove the roughness of the surface which has an impact on the brightness relative to the reflection of the light. The brightening can be carried out in an acid solution, assisted or not assisted by current. It is, in the first case, an electrochemical brightening. By way of example, the samples tested in the laboratory were produced from the Lumia range from Coventya.

The anodizing stage vi) or F) can subsequently be carried out.

By way of example, the electrical transportation wire made of aluminum alloy, for example with a diameter of 3 mm, will be anodized, with a formation of a porous layer of alumina hydroxide all around said electrical transportation wire, by sulfuric acid anodizing (20 to 30% by weight of sulfuric acid in distilled water) at a temperature of 30° C. or by phosphoric acid anodizing (8 to 30% by weight of phosphoric acid in distilled water) at ambient temperature (i.e. 25° C.), under the application of a current density of between 55 and 65 A/dm$^2$. Said electrical transportation wire made of aluminum alloy obtained is thus covered with a porous layer of alumina hydroxide.

In a specific embodiment, the process in accordance with the fourth subject matter or with the fifth subject matter of the invention additionally comprises, after the chemical conversion stage vi) or F) and in particular the anodizing stage, the following stage:

vii) plugging the pores of said porous layer of alumina hydroxide.

This stage vii) makes it possible to improve the compactness of the layer of alumina hydroxide. Subsequent to this stage vii), all the pores at the surface of the layer of alumina hydroxide are blocked.

Stage vii) can, for example, be carried out by performing a hydration of said electrical transportation wire under hot conditions, said electrical transportation wire being immersed in boiling water or hot water.

The plugging can be carried out in water with optionally an additive, for example nickel salt, at a temperature of greater than 80° C., preferably of between 90 and 95° C.

Advantageously, said electrical transportation wire obtained after the chemical conversion stage vi) or F) or said electrical transportation wire obtained after the plugging stage vii) is rinsed with osmosed water.

A sixth subject matter of the present invention is a process for the manufacture of an electric cable in accordance with the third subject matter of the invention, said process comprising the following stages:

Y) manufacturing an electrical transportation wire according to the manufacturing process in accordance with the fourth or fifth subject matter of the invention, and Z) positioning said electrical transportation wire around the elongated reinforcing component.

Thus, the process for the manufacture of the electric cable of the invention is a process which is easy to carry out. Furthermore, it makes it possible to obtain an electric cable simultaneously having good electrical properties (in terms of electrical capacitance and of conductivity) and good mechanical properties (in terms of tensile strength and of hot creep resistance).

More particularly, when said cable comprises an assembly of electrical transportation wires made of aluminum, stage Y) makes it possible to obtain said electrical transportation wires optionally covered with a layer of alumina hydroxide and stage Z) consists in positioning the electrical transportation wires around the reinforcing component, so as to form at least one layer of said electrical transportation wires around said reinforcing component. Preferably, the electrical transportation wires are twisted around said reinforcing component.

In a specific embodiment, in the layer formed around said reinforcing component, each electrical transportation wire exhibits a cross section complementary in shape to the strand(s) which is/are adjacent to it, and being capable of conferring a substantially uniform surface on said layer.

The electric cable according to the invention can exhibit an apparent diameter (that is to say, external diameter) which can range from 10 to 100 mm.

The electric cable of the invention can more particularly be a high voltage electrical transmission cable, in particular of overhead line type having a high alternating voltage of at least 225 kV and which can range up to 800 kV (i.e. OHL cables). This type of cable is generally hung between two pylons.

BRIEF DESCRIPTION OF THE DRAWINGS

Other characteristics and advantages of the present invention will become apparent in the light of the examples which will follow with reference to the annotated figures, said examples and figures being given by way of illustration and without any limitation.

DETAILED DESCRIPTION

For reasons of clarity, the same components have been denoted by identical references. Likewise, only the components essential for the understanding of the invention have been represented diagrammatically, without observing a scale.

Figure 1:
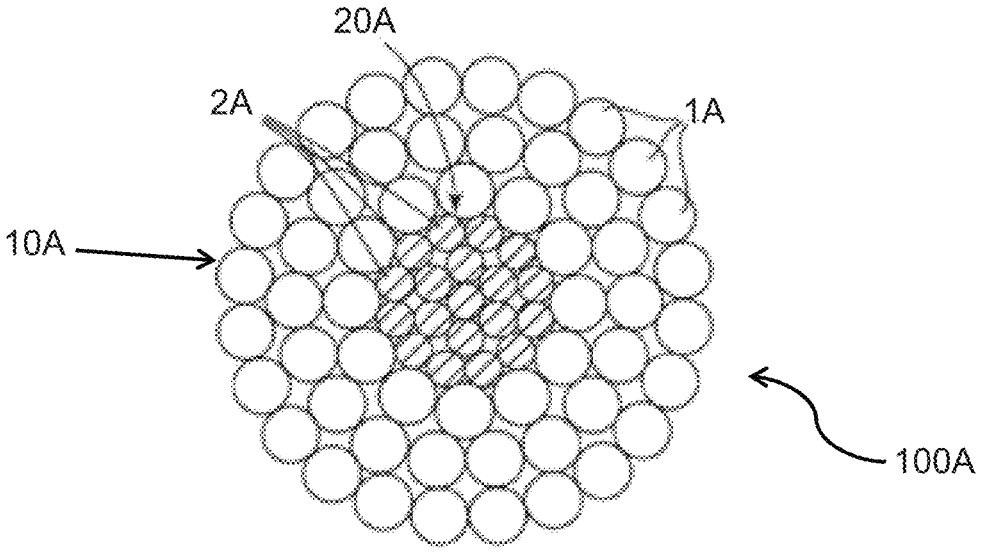
FIG. 1 diagrammatically represents a structure, in cross section, of a first alternative form of an electric cable according to the invention.

FIG. 1 represents a first alternative form of a high voltage electrical transmission electric cable of the OHL type 100A according to the invention, seen in cross section, comprising three layers of an assembly 10A of metal strands 1A of aluminum alloy of the invention. These three layers surround a central elongated reinforcing component 20A. The constituent metal strands 1A of said layers have a round-shaped cross section.

Figure 2:
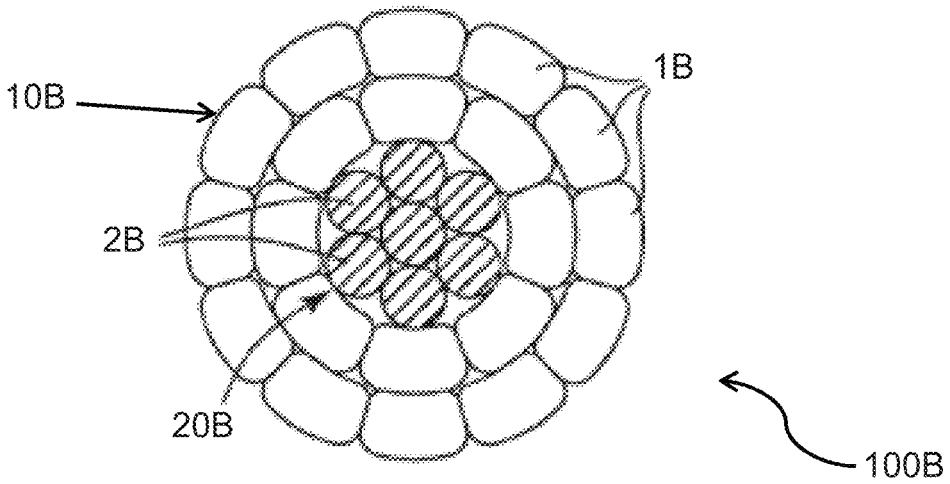
FIG. 2 diagrammatically represents a structure, in cross section, of a second alternative form of an electric cable according to the invention.

FIG. 2 represents a second alternative form of a high voltage electrical transmission electric cable of the OHL type 100B according to the invention, seen in cross section, comprising two layers of an assembly 10B of metal strands 1B of aluminum alloy of the invention. These two layers surround a central elongated reinforcing component 20B. The constituent metal strands 1B of said layers have a trapezoidal-shaped cross section.

Figure 3:
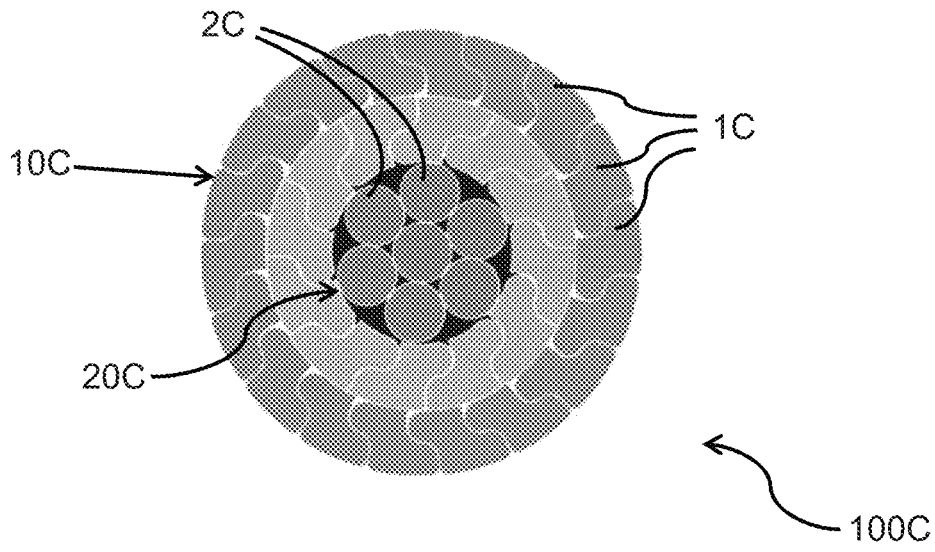
FIG. 3 diagrammatically represents a structure, in cross section, of a third alternative form of an electric cable according to the invention.

FIG. 3 represents a third alternative form of a high voltage electrical transmission electric cable of the OHL type 100C according to the invention, seen in cross section, comprising two layers of an assembly 10C of metal strands 1C of aluminum alloy of the invention. These two layers surround a central elongated reinforcing component 20C. The constituent metal strands 1C of said layers have a Z-shaped (or "S"-shaped, according to the orientation of the Z) cross section. The geometry of the "Z"-shaped strands makes it possible to obtain a surface virtually devoid of any interstices which may bring about accumulations of moisture and thus centers of corrosion.

The central elongated reinforcing component 20A, 20B, 20C represented in FIGS. 1, 2 and 3 can, for example, be steel strands 2A, 2B, 2C or composite strands 2A, 2B, 2C of aluminum in an organic matrix.

In alternative forms of embodiments represented in FIGS. 1 to 3, it is possible to modify the number of strands 1A, 1B, 1C of each layer, their shape, the number of layers or also the number of steel strands or composite strands 2A, 2B, 2C, and also the nature of the aluminum.

Preparation of an Electrical Transportation Wire Made of Aluminum Alloy According to the Process in Accordance with the Fourth Subject Matter of the Invention An alloy was prepared according to the process of the invention in the following way:

Stage i): after having incorporated a master alloy of aluminum, zirconium, copper and iron in a molten bath of aluminum pure to more than 99.5% by weight, everything was mixed in order to homogenize the pure aluminum and the master alloy and to thus form a molten alloy.

Stage ii): the molten alloy was subsequently cast in a cylindrical die in order to form a bar of an "as-cast" alloy which was solidified by cooling: the cylindrical bar formed had a diameter of 30 mm.

Stage iii): the cylindrical bar, directly formed in the preceding stage, was rolled at a temperature of 25° C., in order to obtain a bar having a smaller diameter, namely a bar with a diameter of 10 mm.

Stage iv): the bar from the preceding stage was heated in a conventional resistance furnace at 400° C. for 150 hours in order to form an electrical transportation wire made of aluminum alloy comprising aluminum, 0.3% of zirconium, 0.15% of iron and 0.001% of copper, said alloy comprising 80 parts by weight of zirconium in the form of precipitates per 100 parts by weight of zirconium in said alloy. The amount of zirconium in the form of precipitates in the electrical transportation wire made of aluminum alloy was determined using the phase diagram, by calculation of the amount of zirconium remaining in the solid solution (i.e. zirconium not being in the form of precipitates) on conclusion of stage iv).

Stage v): finally, the electrical transportation wire from the preceding stage was cold drawn, in order to obtain an alloy wire of the invention (i.e. metal alloy strand) with a diameter of 3.5 mm.

The aluminum alloy of the electrical transportation wire comprised at most 0.8% by weight of unavoidable impurities.

Figure 4:
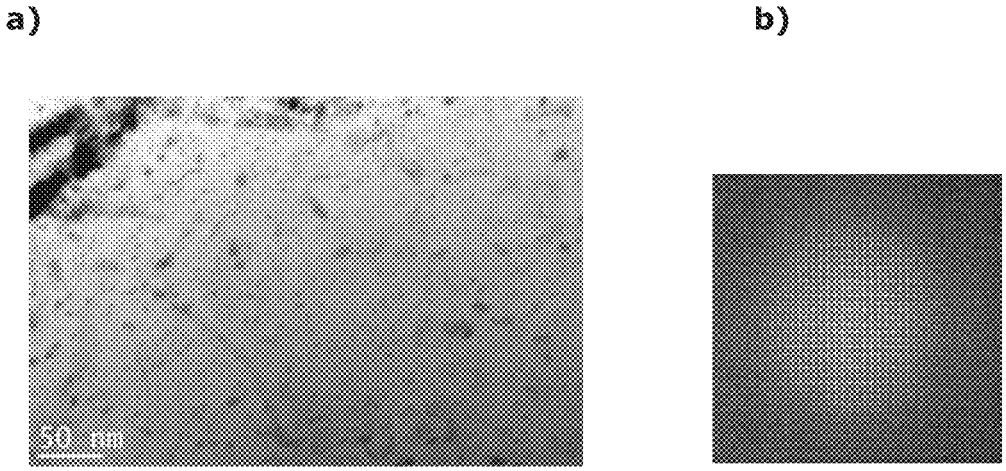
FIG. 4 represents a transmission electron microscopy (TEM) view of the electrical transportation wire made of aluminum alloy of the electric cable of the invention.

FIG. 4 shows a transmission electron microscopy (TEM) view of the aluminum alloy as prepared above in bright field (BF) mode (FIG. 4*a*) and in dark field (DF) mode (FIG. 4*b*).

Transmission electron microscopy (TEM) was carried out with a high resolution transmission electron microscope sold under the reference ARM 200S by Jeol.

The diameter of the zirconium precipitates in the alloy was determined by TEM. To do this, a sample of alloy as prepared above was withdrawn, polished until an alloy thickness of approximately 100 μm was obtained and electrochemically drilled in order to obtain a sample thickness transparent to electrons ranging from 50 to 100 nm approximately.

It could thus be observed that the process in accordance with the invention and in particular the casting stage ii) and the heating stage iv) makes it possible to obtain a homogeneous dispersion of controlled microstructure of zirconium precipitates and in particular to obtain spherical zirconium precipitates with a diameter ranging from 1 to 100 nm approximately.

In contrast, it has been found that, when the operating conditions of the casting stage ii) and/or of the heating stage iv) were not optimal (e.g., casting stage carried out at an excessively low temperature, that is to say at a temperature of less than 680° C., cooling rate during the casting stage too low, that is to say less than 50° C./min, heating stage carried out for an excessively long period of time, that is to say greater than 500 hours), the zirconium precipitates obtained on conclusion of stage iv) were coarse, in particular with a diameter of greater than 100 nm.

Tensile Strength of the Electrical Transportation Wire Made of Aluminum Alloy Prepared According to the Process in Accordance with the Fourth Subject Matter of the Invention Table 1 below shows the tensile strength (in MPa) of several electrical transportation wires made of aluminum alloy A1, A2, A3, A4 and A01, their electrical conductivity (in % IACS) and the loss of their mechanical properties after aging at 230° C. for 1 hour (i.e. loss of the tensile strength, in ΔUTS).

A1, A2, A3 and A4 were manufactured according to the process of the invention as described in the example above, with different heating parameters according to the amount of zirconium present in them, and A01 was sold under the reference Al1120 by Nexans. A01 does not form part of the invention since it does not comprise zirconium.

TABLE 1

| Alloy | Zirconium content (%) | Copper content (%) | Iron content (%) | Tensile strength before aging (MPa) | Electrical conductivity (% IACS) | ΔUTS (%) |
|---|---|---|---|---|---|---|
| A01 | 0 | 0.17 | 0.27 | 229.8 | 59.1 | −18.2 |
| A1 | 0.568 | 0.17 | 0.27 | 220.4 | 59.4 | −9.3 |
| A2 | 0.487 | 0.17 | 0.27 | 225.3 | 59.3 | −6.7 |
| A3 | 0.426 | 0.17 | 0.27 | 207.1 | 59.1 | −7.0 |
| A4 | 0.349 | 0.17 | 0.27 | 221.8 | 59.5 | −8.6 |

A1, A2, A3 and A4 were respectively obtained with the following heating parameters of stage iv): 400° C./300 hours, 400° C./250 hours, 400° C./220 hours and 400° C./180 hours.

Thus, from table 1 illustrated above, it can be seen that the electrical transportation wires made of aluminum alloy manufactured according to the process in accordance with the invention exhibit good mechanical properties before and after aging and good electrical properties.

In addition, the presence of the zirconium in the aluminum alloy makes it possible to reduce the loss in mechanical properties after aging, while guaranteeing good electrical properties.

Figure 5:
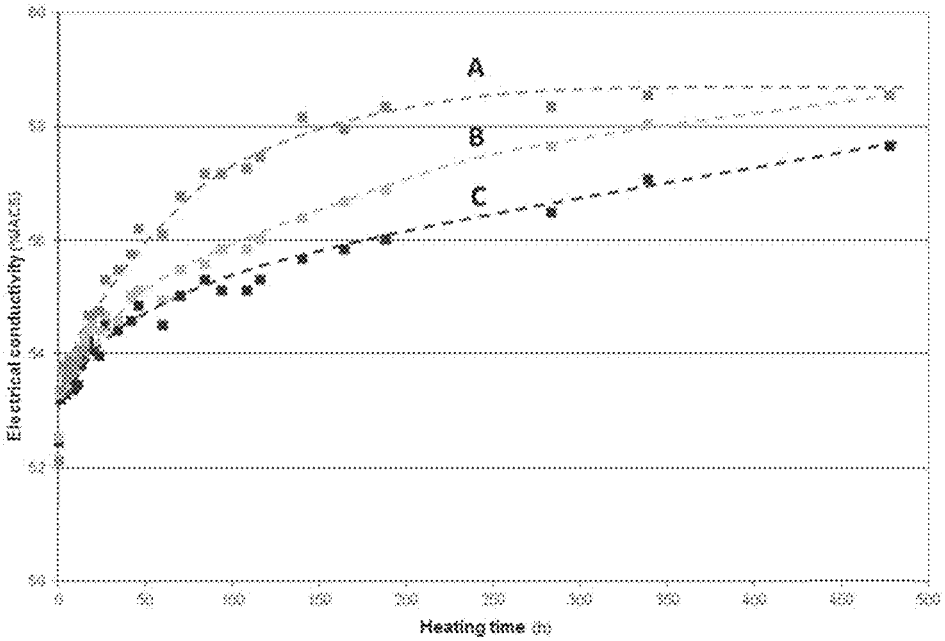
FIG. 5 represents the curves of the electrical conductivity of the electrical transportation wire of the electric cable of the invention as a function of the heating time of stage iv) of the fourth subject matter of the invention for different heating temperatures.

Study of the Electrical Conductivity of the Electrical Transportation Wire Made of Aluminum Alloy as a Function of the Heating Time and of the Heating Temperature of the Fourth Subject Matter of the Invention FIG. 5 shows the electrical conductivity of the electrical transportation wire made of aluminum alloy of the invention as a function of the heating time of stage iv) of the process in accordance with the invention when stage iv) is carried out at a heating temperature of 450° C. (curve A), 400° C. (curve B) and 350° C. (curve C).

The alloy used in this example was prepared as in the examples described above and comprised 0.35% of zirconium, 0.27% of iron and 0.17% of copper.

It can thus be observed that the temperature and time parameters used during said stage iv) are interdependent and that they have a direct impact on the electrical conductivity of the alloy obtained. Examples of time/temperature pairs which make it possible, during stage iv), to form sufficient zirconium precipitates and thus to obtain a conductivity of at least 57% IACS include the following time/temperature pairs: 100 hours/450° C. approximately, 200 hours/400° C. approximately and 340 hours/350° C. approximately.

Preparation of an Electrical Transportation Wire Made of Aluminum Alloy According to the Process in Accordance with the Fifth Subject Matter of the Invention An electrically conducting component made of aluminum alloy A5 was prepared according to the process in accordance with the invention in the following way:

Stage A): after having incorporated a master alloy of aluminum and zirconium in a molten bath of aluminum pure to more than 99.5% by weight, everything was mixed in order to homogenize the pure aluminum and the master alloy and to thus form a molten alloy.

Stage B): the molten alloy was subsequently cast in a cylindrical die in order to form a bar of an "as-cast" alloy which was solidified by cooling: the cylindrical bar formed had a diameter of 30 mm.

Stage C): the cylindrical bar, directly formed in the preceding stage, was rolled at a temperature of 25° C., in order to obtain a bar with a smaller diameter, namely a bar with a diameter of 10 mm.

Stage D): the bar from the preceding stage was heated at 400° C. for 180 hours in order to form an electrical transportation wire made of aluminum alloy comprising aluminum and 0.35% of zirconium.

Stage E): said electrical transportation wire from the preceding stage was cold drawn in order to obtain an alloy wire of the invention (i.e. metal alloy strand) with a diameter of 3.5 mm.

Stages a) and b): said electrical transportation wire made of aluminum of the preceding stage was stripped and degreased by immersing it in a solution of sodium hydroxide and surfactants sold under the Gardoclean reference by Chemetall (30 to 50 g/l of sodium hydroxide), at a temperature ranging from 40 to 60° C. approximately, for a period of time of approximately 30 seconds.

Stage c): said electrical transportation wire made of aluminum from the preceding stage was then immersed in a sulfuric acid solution (20% by weight of sulfuric acid in distilled water) at ambient temperature (i.e. 25° C.) for 10 seconds.

Stage F): a porous layer of alumina hydroxide was formed at the surface of the electrical transportation wire from the preceding stage by sulfuric acid anodizing (20% by weight of sulfuric acid in distilled water) at a temperature of 25 to 35° C., under the application of a current density of between 55 and 65 A/dm$^2$. Said electrical transportation wire made of aluminum alloy which is obtained is thus covered with a porous layer of alumina hydroxide. The thickness of said porous layer of alumina hydroxide ranges from 8 to 10 μm approximately.

Stage vii): the pores of the porous layer of alumina hydroxide as formed in the preceding stage were plugged by immersing said electrical transportation wire from the preceding stage in hot water.

The aluminum alloy A5 of the electrical transportation wire comprised at most 0.8% by weight of unavoidable impurities.

The diameter of the zirconium precipitates was determined by the TEM method, as described in example 1, on the A5 alloy as prepared on conclusion of the wire drawing stage E) (i.e. before the stripping, degreasing, neutralizing, anodizing and plugging stages).

The inventors of the present patent application were thus able to confirm that the process in accordance with the invention makes it possible to obtain a homogeneous dispersion of controlled microstructure of zirconium precipitates and in particular to obtain spherical zirconium precipitates with a diameter ranging from 1 to 20 nm approximately.

The temperature stability (in ° C.) of several electrical transportation wires made of aluminum alloy A5, A6, A02 and A03, their electrical conductivity (as % IACS), their emissivity, their absorption, their diameter, the diameter and the section of the corresponding cables (in mm), intensity (in A) and the increase in intensity (in %) of the cables respectively comprising the electrical transportation wires made of aluminum alloy A03, A5 and A6, in comparison with the cable comprising the electrical transportation wire made of aluminum alloy A02, are shown in table 2 below.

A6 was manufactured according to the process in accordance with the fourth subject matter of the invention and as described in the first example of the present patent application (with the following heating parameters of stage iv): 400° C./180 hours).

It comprised aluminum and 0.35% of zirconium (said alloy did not comprise iron and copper). A6 did not comprise a porous layer of alumina hydroxide.

A02 (pure aluminum) was sold under the reference Al1350 by Nexans. A02 did not comprise a porous layer of alumina hydroxide.

A03 was manufactured from A02 by carrying out only stages a), b), c), F) and vii) described above in the present example. A03 thus comprised a porous layer of alumina hydroxide.

A02 and A03 do not form part of the invention since they do not comprise zirconium.

TABLE 2

| | A02 | A03 | A6 | A5 |
|---|---|---|---|---|
| Maximum temperature (° C.) | 80° C. | 80° C. | 210° C. | 210° C. |
| Conductivity (% IACS) | 62% | 62% | 60% | 60% |
| Emissivity | 0.4 | 0.92 | 0.4 | 0.92 |
| Absorption | 0.85 | 0.5 | 0.85 | 0.5 |
| Diameter of the wire (mm) | 3.500 | 3.500 | 3.513 | 3.513 |
| Diameter of the cable (mm) | 31.50 | 31.50 | 32.52 | 31.52 |
| Section ($mm^2$) | 346.46 | 346.46 | 357.67 | 357.67 |
| Intensity (A) | 1360 | 1549 | 2334 | 2688 |
| Increase in intensity (%) | — | 13.91 | 71.59 | 97.68 |

In addition to improved mechanical properties at a temperature of 210° C. in continuous use during a period ranging up to 40 years, the acceptable maximum intensity is particularly increased by virtue of the invention, as is shown by the calculations of table 2 above, carried out on round electrical transportation wires.

The invention claimed is:

1. An electrical transportation wire made of aluminum alloy, wherein said electrical transportation wire comprises:
- aluminum,
- from 0.2% to 0.6% by weight of zirconium and
- from 0.25% to 0.4% by weight of iron,
- from 0.12% to 0.35% be weight of copper, and
- unavoidable impurities, said unavoidable impurities including Mn and Si, and
- wherein said alloy comprises at least 80 parts by weight of zirconium in the form of precipitates $Al_3Zr$ per 100 parts by weight of zirconium in said aluminum alloy,
- wherein the aluminum alloy has at most 0.08% by weight of Mn and at most 0.08% by weight of Si, and
- wherein said alloy has an electrical conductivity of at least 57% IACS, and
- wherein said electrical transportation wire comprises, at the surface, a porous layer of alumina hydroxide.

2. The electrical transportation wire as claimed in claim 1, wherein said aluminum alloy comprises from 0.2 to 0.5% by weight of zirconium.

3. The electrical transportation wire as claimed in claim 1, wherein the diameter of the zirconium precipitates $Al_3Zr$ ranges from 1 to 200 nm.

4. The electrical transportation wire as claimed in claim 1, wherein said aluminum alloy comprises from 0.25% to 0.35% by weight of iron.

5. The electrical transportation wire as claimed in claim 1, wherein said aluminum alloy comprises from 0.12% to 0.22% by weight of copper.

6. The electrical transportation wire as claimed in claim 1, wherein said zirconium precipitates $Al_3Zr$ are spherical.

7. The electrical transportation wire as claimed in claim 1, wherein the aluminum content of the aluminum alloy of the electrical transportation wire is at least 98.00% by weight.

8. The electrical transportation wire as claimed in claim 1, wherein the content of unavoidable impurities in the aluminum alloy of the electrical transportation wire is at most 1.10% by weight.

9. The electrical transportation wire as claimed in claim 1, wherein the unavoidable impurities is one or more of the following elements: Ag, Cd, Cr, Mg, Mn, Pb, Si, Ti, V, Ni, S and/or Zn.

10. The electrical transportation wire as claimed in claim 1, wherein it is obtained by implementing a heating stage iv) at a temperature of 400 to 500° C.

11. The electrical transportation wire as claimed in claim 1, wherein said electric transportation wire has a round-section diameter or a round-section equivalent diameter ranging from 2.25 mm to 4.75 mm.

12. The electrical transportation wire as claimed in claim 1, wherein at least said electrical transportation wire is, along with an elongated reinforcing component, included within an electric cable, forming an aerial cable for the transportation of energy.

13. The electrical transportation wire as claimed in claim 12, wherein the elongated reinforcing component is surrounded by said electrical transportation wire made of aluminum alloy.

14. The electrical transportation wire as claimed in claim 12, wherein the electrical transportation wire made of aluminum alloy is twisted around the elongated reinforcing component.

15. The electrical transportation wire as claimed in claim 12, wherein said electric cable further comprises an assembly of said electric transportation wires made of said aluminum alloy.

16. The electrical transportation wire as claimed in claim 15, wherein all of said electric transportation wires are wound around the elongated reinforcing component.

17. A process for the manufacture of an electrical transportation wire as claimed in claim 1, wherein said process comprises the following stages:

i) forming a molten aluminum ahoy comprising aluminum, zirconium, unavoidable impurities and optionally an element chosen from copper, iron and theft mixture;

ii) casting the molten alloy of stage i), in order to obtain an as-cast alloy;

iii) rolling the as-cast alloy of stage ii), in order to obtain a rolled alloy;

iv) heating the rolled alloy of stage iii), in order to obtain said electrical transportation wire made of aluminum alloy, said alloy comprising at least 80 parts by weight of zirconium in the form of precipitates (A13Zr) per 100 parts by weight of zirconium in said aluminum alloy; thereby forming the electrical transportation wire of claim 1.

18. The process as claimed in claim 17, wherein the heating of stage iv) is carried out at a temperature ranging from 300 to 500° C. for a period of time ranging from 100 to 500 hours.

19. The process as claimed in claim 17, wherein the process additionally comprises the following stage:

v) cold working the electrical transportation wire of stage iv), in order to obtain an electrical transportation wire with the desired dimensions.

20. The process as claimed in claim 17, wherein the cooling during the casting stage ii) is carried out at a rate of at least 50° C./min, from the casting temperature down to 500° C.

21. The process as claimed in claim 17, wherein said process additionally comprises the following stage:

vi) forming, by chemical conversion, a porous layer of alumina hydroxide at the surface of said electrical transportation wire.

22. The process as claimed in claim 21, wherein stage vi) is carried out by anodizing.

23. The process as claimed in claim 21, wherein said process additionally comprises, before stage vi), at least one of the following stages:

a) degreasing the electrical transportation wire, and/or b) stripping the electrical transportation wire.

24. The process as claimed in claim 21, wherein said process additionally comprises, before stage vi), the following stage:

c) neutralizing the electrical transportation wire.

25. The process as claimed in claim 21, wherein said process additionally comprises, after stage vi), the following stage:

vii) plugging the pores of said porous layer of alumina hydroxide.

* * * * *